US005673539A

United States Patent [19]

Jonovic et al.

[11] Patent Number: 5,673,539

[45] Date of Patent: Oct. 7, 1997

[54] ON-LINE SHREDDER AND LOADER

[75] Inventors: John A. Jonovic, Fitchburg; Kenneth M. Detert; Matthew D. Wilfong, both of Madison, all of Wis.

[73] Assignee: Kraft Foods, Inc., Northfield, Ill.

[21] Appl. No.: 633,981

[22] Filed: Apr. 17, 1996

[51] Int. Cl.[6] ..... B65B 63/00

[52] U.S. Cl. ..... 53/435; 53/473; 53/513; 53/518; 53/237; 241/93; 83/932

[58] Field of Search ..... 53/513, 515, 237, 53/246, 435, 467, 473, 244, 121, 518, 258; 426/518; 241/93; 83/932

[56] References Cited

U.S. PATENT DOCUMENTS

| | | | |
|---|---|---|---|
| 3,680,798 | 8/1972 | Moser et al. | 241/93 |
| 4,145,453 | 3/1979 | Lenhardt, Sr. | 426/518 |
| 4,446,672 | 5/1984 | Raudat | 53/246 |
| 4,887,410 | 12/1989 | Gandini | 53/237 |
| 5,205,495 | 4/1993 | Garnier | 53/121 |
| 5,324,529 | 6/1994 | Brockinell | 53/518 |
| 5,364,037 | 11/1994 | Bigelow | 241/93 |
| 5,379,575 | 1/1995 | Focke et al. | 53/246 |
| 5,481,851 | 1/1996 | Koenig | 53/513 |

FOREIGN PATENT DOCUMENTS

| | | | |
|---|---|---|---|
| 2125489 | 5/1971 | Germany | 53/518 |
| 0074991 | 7/1978 | Japan | 53/246 |

*Primary Examiner*—John Sipos
*Assistant Examiner*—Gene L. Kim
*Attorney, Agent, or Firm*—Lockwood, Alex, Fritzgibbon & Cummings

[57] ABSTRACT

An apparatus and method are providing for shredding and loading pre-portioned quantities of products, typically food products such as cheeses. The food product or the like is shredded at an on-line location which is a component of a filling and sealing line by which a plurality of pockets of packaging components are filled and then sealed under vacuum or gas-flushed conditions. The resulting pre-portioned shredded or grated product is moved into one of the pockets of the packaging component prior to the sealing operation. This movement is coordinated and in timed sequence with a conveyor assembly which properly positions the pocket under the fixture through which the grated product flows. Tamping equipment can be provided by which the grated product is leveled off while it is within the pocket and prior to sealing. Multiple pocket filling is also addressed.

11 Claims, 5 Drawing Sheets

ON-LINE SHREDDER AND LOADER

BACKGROUND AND DESCRIPTION OF THE INVENTION

This invention generally relates to a shredding and loading apparatus for automatically grating pre-portioned product and loading the thus-grated product into a packaging component. The invention is specifically well-suited to grating and loading pre-portioned cheese or other food products which can be grated, while promptly thereafter loading the grated pre-portioned product directly into a pocket or the like of a packaging component within which the product is subsequently sealed and marketed. The invention is especially useful for achieving the shredding and loading directly on a production line along which other products are loaded into the packaging, with the result that multiple, different products are packaged and sealed within the package to be marketed. In this connection, the invention can advantageously incorporate a number of different stations which carry out shredding and loading of a plurality of products into a plurality of packaging components and/or pockets.

Occasions arise when it is necessary to shred materials which are intended for eventual combining with other components. An example is an arrangement wherein multiple components are individually packaged but bear a relationship to each other such that they would normally be combined and used together upon opening their packaging at a later date. Some such examples in this regard are packages of the type having a tray with recessed compartments or pockets for receiving and holding food products and the like, the tray being covered by a thin, flexible and typically transparent film which seals the products in their respective recessed compartments or pockets. Examples of this type of packaging are found in Grindrod U.S. Pat. Nos. 5,042,652 and 5,119,940, Hustad U.S. Pat. Nos. 5,123,527 and 5,375,701, and in Griesbach U.S. Pat. No. 5,312,634.

Specific examples of products of this type are multi-pocketed or multi-compartmented sealed packages which incorporate shredded component products. Typical in this regard is shredded or grated cheese. Grated cheese is susceptible to agglomeration and compaction, making it difficult to transfer from a large quantity, such as within a storage bin of grated cheese, to numerous smaller quantities, each of a predetermined weight and volume.

In addition, with shreddable products such as shreddable food products, most notably grated cheeses, their extensive surface area makes them especially susceptible to deterioration, such as mold growth, if left in the open air or otherwise unprotected for unnecessarily long lengths of time. With the types of packaging contemplated for use in connection with the present invention, the individual products, after filling, are sealed under vacuum or gas flush conditions, and it will be appreciated that it is important to have the product components, especially shredded food product components, sealed within the desired protective atmosphere as soon as possible. In the case of shredded or grated product components, the importance of minimizing the time between shredding and sealing within the packaging will be appreciated.

In accordance with the present invention, the problems associated with providing pre-portioned quantities of grated product such as cheeses are addressed. Also addressed are the objectives that the handling time between grating and loading be as short as reasonably possible while also minimizing handling procedures that could cause bunching of the grated pieces and undesirable agglomeration or compaction so that the advantageous grated attributes of the product, when packaged, are not undesirably reduced. Normally, one would provide a grated product so that, when unpackaged, it will spread relatively easily and be in a form within which it more readily melts onto other food components. In an especially preferred use of the present invention, the packaged product is a ready-to-assemble pizza type product in which shredded or grated cheese or cheeses will be sprinkled over other components.

The apparatus automatically shreds and loads a pre-portioned quantity of a product such as cheese and the like into a pocket or compartment of a packaging component or tray within which the shredded pre-portioned product is to be marketed, typically in conjunction with other product components that are individually sealed within their own respective compartments. In its apparatus aspect, the invention incorporates a rotating grater having a staging compartment adjacent thereto. A pre-portioned quantity of the product to be shred, such as a block of cheese or the like, is positioned within the staging compartment, after which it is pushed into the rotating grater in order to thereby grate desirably the entirety of the pre-portioned product. The resulting pre-portioned grated product falls through a transfer passageway and into the pocket or compartment of the packaging component. The packaging component had been conveyed to, or otherwise positioned at, the location for receiving the freshly shredded pre-portioned product. After loading in this manner, the thus loaded packaging component is conveyed to another station for eventual sealing of the packaging component. The result is a sealed, marketable package that includes the grated cheese, cheeses or the like sealed within the protective atmosphere of a vacuum or of a gas-flushed environment.

It is accordingly a general object of the present invention to provide an improved shredder and load apparatus and method which are especially well adapted for on-line applications.

Another object of the present invention is to provide an improved automatic shredding and loading apparatus and method that will readily provide pre-portioned quantities of freshly grated cheese which is readily loaded into a packaging component for prompt protective sealing.

Another object of this invention is to provide an improved automatic shredding and loading apparatus and method in a manner that substantially avoids the possibility of shredded product being deposited onto a package edge surface that is to be sealed in a gas-tight manner.

Another object of the present invention is to provide an improved apparatus and method for shredding and loading cheese and other food products in an automatic and multiple-stage arrangement whereby different pockets or compartments of the same packaging component are loaded with differing shredded pre-portioned products.

These and other objects, features and advantages of the present invention will be apparent from and clearly understood through a consideration of the following detailed description.

BRIEF DESCRIPTION OF THE DRAWINGS

In the course of this description, reference will be made to the attached drawings, wherein.

DETAILED DESCRIPTION OF THE INVENTION

Figure 1:
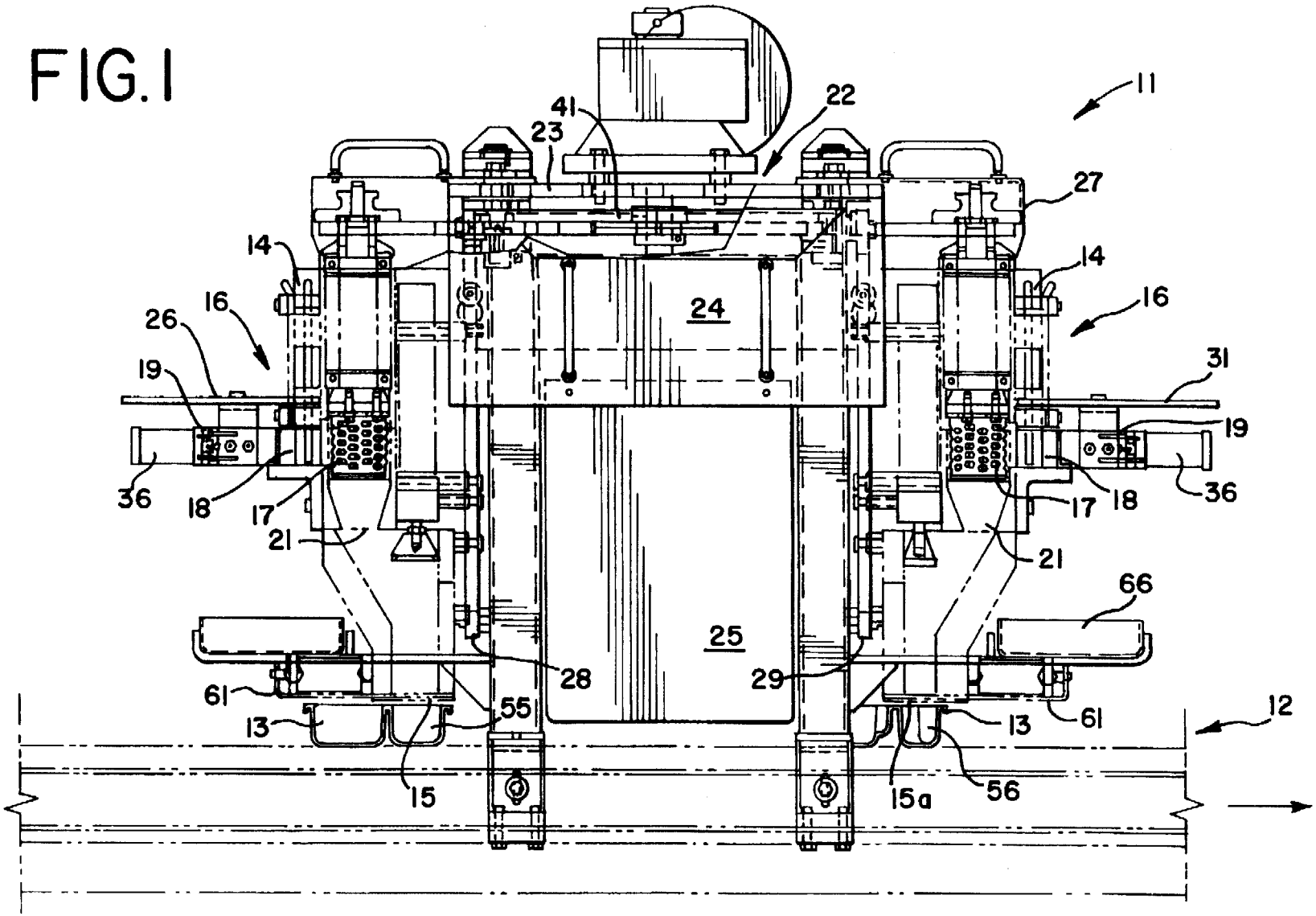
FIG. 1 is an elevational view of a preferred on-line shredder and loader in accordance with the invention.

A shredder and loader is generally designated by reference numeral 11 in FIG. 1. It is shown in an on-line arrangement in that it is positioned along a conveyor assembly 12 which transfers a plurality of packaging components or trays 13 between stations of the loading and sealing line. Other stations of the line are not illustrated. They would include one or more stations for filling another compartment or other compartments of the packaging components or trays 13, as well as downstream locations for sealing the trays, packaging and the like. In a preferred arrangement, the trays are sealed with a flat and flexible film. The flow of the conveyor is in the direction of the arrow as shown. Product of a known quantity of weight and/or volume is inserted into each of the entrances 14, automatically shred, and loaded into a tray 13 at exit area 15.

In the illustrated arrangement, the packaging components or trays 13 have a plurality of pockets or compartments within which the shredded material is to be deposited. Thus, the illustrated apparatus features two exits, 15 and 15A. One of the compartments is filled at exit 15. Thereafter, the thus partially filled tray is conveyored to and properly positioned at exit 15A, at which another compartment or pocket is filled. Also in accordance with the illustrated embodiment, the two components or pockets are of different sizes or volumes. As will be explained in greater detail hereinafter, it is preferred that each exit have a configuration and size which generally approximates that of its respective compartment or pocket.

With more particular reference to the illustrated apparatus, same includes a plurality of fixtures, generally designated at 16, which are arranged above the conveyor assembly 12 in order to achieve the shredding and loading of product into the trays 13. The illustrated embodiment shows eight such fixtures 16 (FIG. 2), four at the upstream end and four at the downstream end of the shredder and loader 11. Each fixture assembly 16 includes a grater 17, a staging compartment 18, a pusher assembly 19, and a transfer passageway 21 through which the grated product falls toward and through each exit 15, 15A.

Each fixture 16 is mounted to a supporting frame, generally designated at 22. Supporting frame has associated with it various support plates and guards such as top plate 23, side guard 24, bottom side guard 25, large shelf guard 26, drive guard 27, right side plate 28, left side plate 29 and small shelf guard 31.

Figure 5:
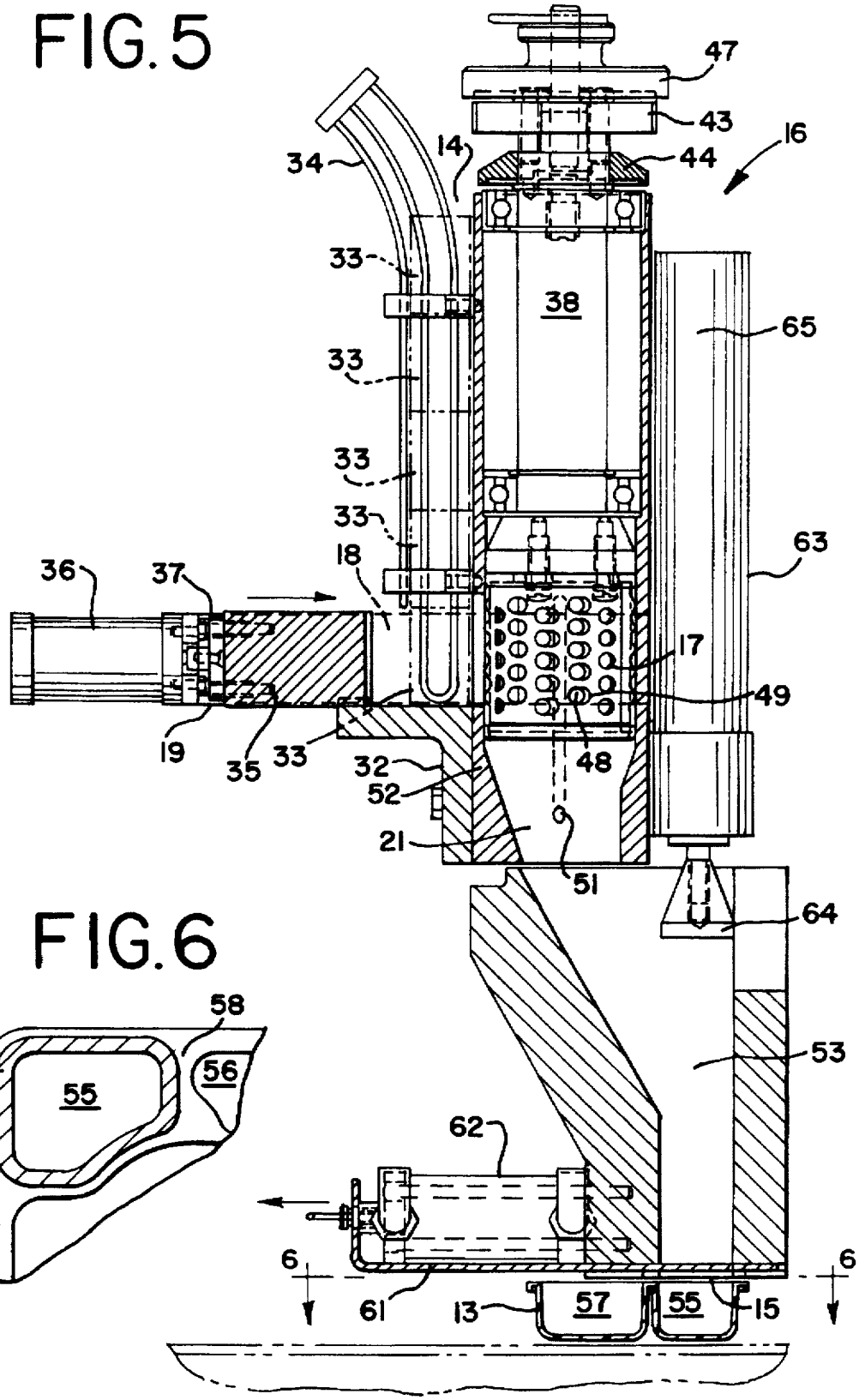
FIG. 5 is a cross-sectional view along the line 5—5 of FIG. 3.

Preferred fixtures are perhaps best illustrated in FIG. 5. An angle component 32 helps attach each fixture and its components to the supporting frame. In this embodiment, reference will be made to having cheese blocks shredded and loaded into the packaging component or tray 13. Each cheese block is identified by reference numeral 33. A total of five cheese blocks are shown, the bottommost one being positioned within the staging compartment 18. A magazine arrangement or chute 34 conveniently functions as a feeder assembly for receiving and passing the cheese blocks 33. It has been found that a gravity feed performs adequately, in combination with manual block filling as desired.

The illustrated pusher assembly 19 includes a push block 35 and a drive cylinder 36, in combination with a suitable bracket 37. A suitable drive cylinder is a Bimba® air cylinder. It will be appreciated that the cylinder will move the block 35 in the direction of the arrow, to the right, as depicted in FIG. 5. By this operation, the bottommost cheese block 33 is pushed up against the outside surface of the grater 17. Movement continues until the cheese block has been substantially entirely grated, at which time the leading portion of the push block 35 is very closely spaced from the outside surface of the grater 17. Thereafter, the drive cylinder 36 retracts the push block 35, thereby opening up the staging compartment 18, at which time the next cheese block 33 is free to drop into the staging compartment 18.

The illustrated grater 17 is rotatably mounted and operated. A spindle assembly 38 is suitably mounted and secured to the grater 17. Spindle 38 is driven by suitable power input and transmission components. These illustrated components include motor 39 (FIG. 2), drive gear 41, and idler gears 42 for transmitting rotational power from the motor to the individual fixtures 16. When desired, all eight shredders can be rotated simultaneously.

Figure 3:
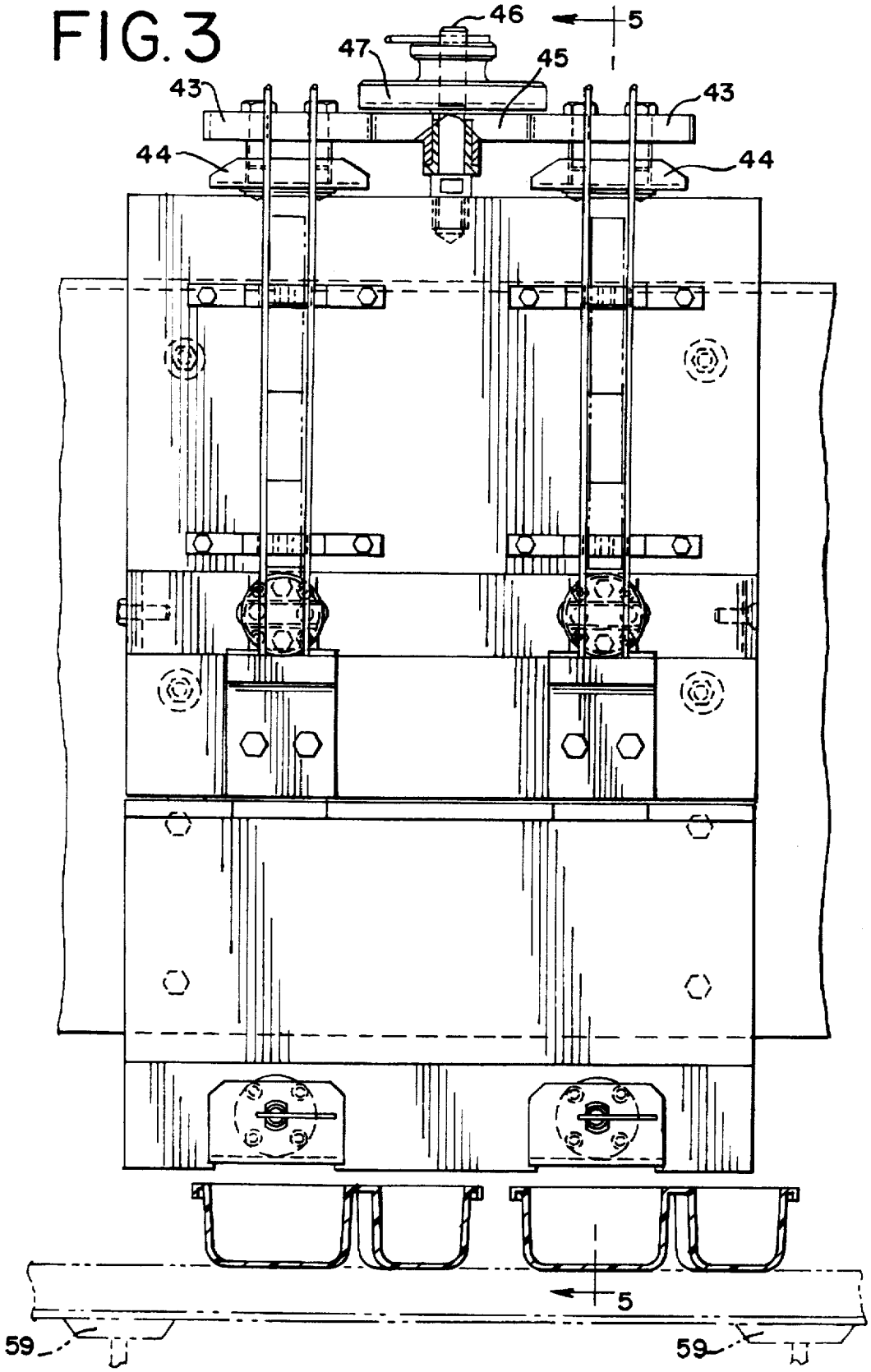
FIG. 3 a detailed end elevational view of a joined pair of shredder and loader station assemblies.
Figure 4:
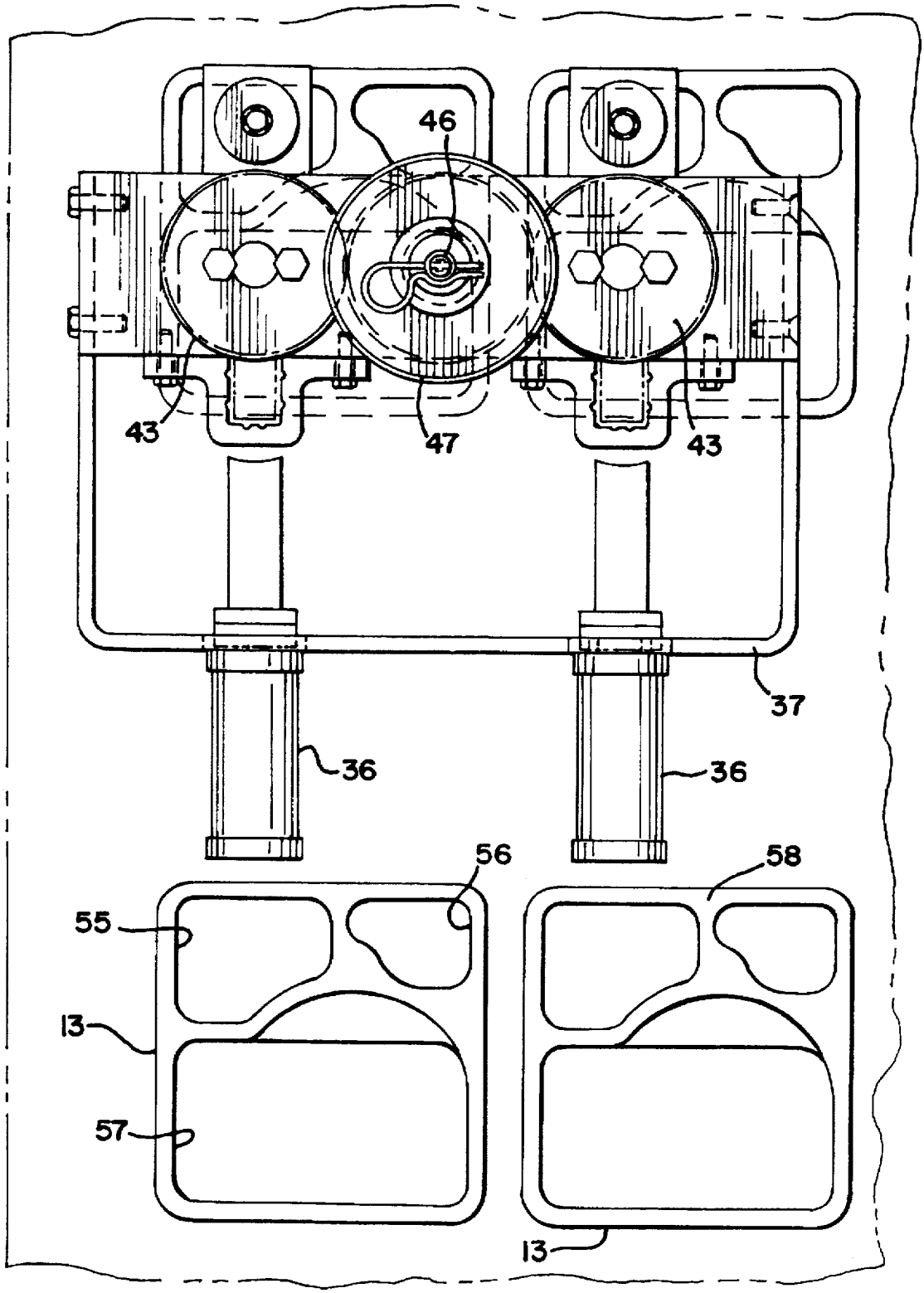
FIG. 4 is a top plan view of the assemblies generally illustrated in FIG. 3.

As illustrated in FIG. 3 and FIG. 4, a gear 43 is drivingly attached to each spindle assembly 38, including a slinger 44, for example. An idler gear 45 connects these two assemblies, in association with a idler stud 46, and a retainer 47, as well as associated components such as a retainer ring, a thrust bearing and a bushing.

The grater 17 is a cylindrically shaped device which is open in the center. It includes a plurality of orifices 48 having blade components 49 which cut into the cheese block positioned thereagainst by the push block 35. The result is the shredding or grating of the cheese block 33, and the individual shreds of cheese pass through the various orifices 48, into the central open area of the grater 17, after which the gratings fall downwardly toward the transfer passageway 21. To the extent that gratings might not promptly disengage from the inside surface of the grater 17, a wiper 51 can be provided. In general, the cheese block is pushed through the orifices of the generally thin-walled grater while it is rotating, and any hung-up grated cheese can be scraped off of the inside surface of the grater cylinder, until the cheese block has been grated and has fallen downwardly as a pre-portioned collection of cheese gratings.

In the illustrated embodiment, the spindle and grater are positioned within a hollow portion of a housing 52, the latter portion of which defines, either alone or in combination with other components, the transfer passageway as discussed herein. One of these other components can be the funnel housing 53. To the extent necessary, this funnel housing 53 assists in precisely directing the pre-portioned group of cheese shreds to exit 15. Generally speaking, the exit 15 can be a component of the funnel housing 53.

Figure 6:
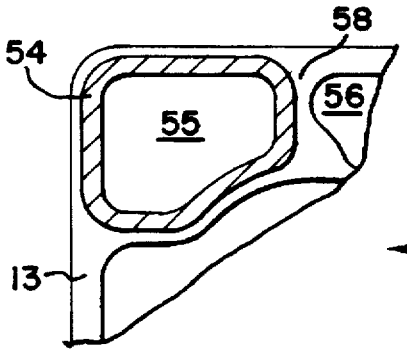
FIG. 6 is a cross-sectional enlarged and partially broken-away view along the line 6—6 of FIG. 5.

In an especially preferred arrangement, the exit 15 has a size and cross-section which is substantially the same as that of the tray pocket which is being filled at that station. This is perhaps best illustrated in FIG. 5 and FIG. 6. The cross-sectional area of exit lip 54 has a configuration which is substantially the same as the configuration of pocket 55 (also shown in FIG. 2 and FIG. 4). Although not shown, the preferred cross-sectional configuration of the lip of exit 15A will be similar to that of pocket 56 of the packaging component or tray 13. Another pocket 57 is shown. This can be suitably provided for packaging other components that are not shredded, such as baked discs, meat, sauce, and the like.

With this complementary configuration and size relationship between the exit lips and the tray pockets for receiving and storing the grated product, there is a reduced likelihood that grated product will fall onto the sealing edge face 58 of the packaging component or tray 13. It will be appreciated that, with this preferred arrangement that is illustrated in the drawings, a sheet of film material will, after filling in accordance with the present invention, be sealed onto this edge face 58. In the event that grated material had inadvertently fallen onto the sealing edge face 58, the seal which is very important to this type of product has a great risk of being compromised.

The risk of having the filling operation cause a sealing defect is further reduced by another feature of the illustrated invention. The conveyor assembly 12 is made such that it can be indexed or lifted upwardly so that the sealing edge face 58 of the tray and the exit lip 54 of the transfer passageway are in engagement with each other, or are at least closely spaced from each other by a distance that will preclude stray shreds from making their way onto the sealing edge face of the tray. In the illustrated embodiment, the conveyor is of a pin conveyor construction, and lifters 59 (FIG. 3) are provided. Lifters move the top surface of the trays from the spaced location illustrated in, for example FIG. 3, to the much more closely spaced arrangement shown in FIG. 5. Alternatively, provision can be made for having the shredder and loader assembly move downwardly, while the conveyor remains in the same plane.

Assemblies are also preferably provided in order to enhance the efficiency, reproduceability, and timing of the equipment. Included in this regard is a slide gate 61 for each of the fixtures. This slide gate opens and closes the exit in accordance with appropriate timing. Such slide gate is shown in a fully closed mode in both FIG. 1 and FIG. 5. When opened as indicated by the arrow in FIG. 5, the grated cheese block is free to pass through the exit. In a typical approach, this movement is effected by a cylinder 62, such as Bimba® air cylinder. Gates which do not slide, or which slide in a different direction, can be substituted as desired.

Another preferred assembly which is useful in this regard is tamping assembly 63. This includes a tamping tool 64 and a double acting cylinder 65. When used, the tamping tool 64 will assist, to the extent necessary, in the downward movement of the shredded product block through the funnel housing 53, out the exit 15, and into the tray pocket 55. It can also extend downwardly until it enters just into the tray pocket, thereby assuring desired placement and top end appearance of the grated product.

In the illustrated apparatus, the larger of the two pockets for the grated product, pockets 55 in the illustrated example, are filled first at the left side fixtures as shown in FIG. 1. These pockets could receive, for example, cheese that is white in color. Then, these same packaging components or trays 13 move to the right as shown in FIG. 1 until their smaller pockets 56 are in alignment with the respective exits or lips of the right side fixtures. At this location, another product, such as cheese that is yellow in color, will be filled into the smaller pockets. Then, at an appropriate time, the trays are sealed with sheeting or the like at the time that the pockets are evacuated or gas-flushed.

In the apparatus that is illustrated, catch pans 66 are provided for catching the crumbs or portions of each cheese block which cannot be passed through the rotating grater 17. These will simply fall by gravity into the catch pans, which can be emptied in any suitable manner, including simple hand dumping.

Figure 2:
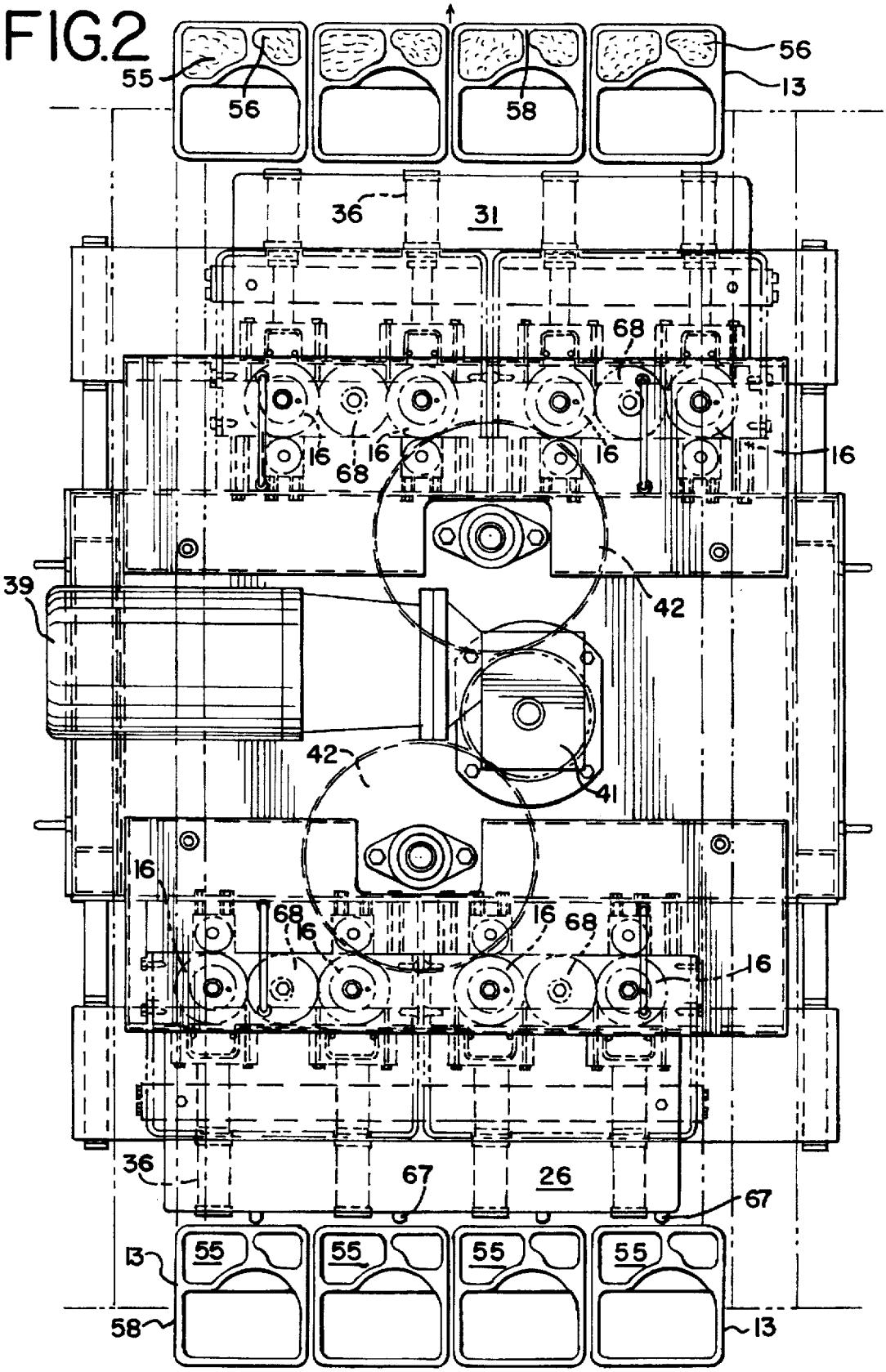
FIG. 2 is a top plan view of the apparatus illustrated in FIG. 1.

Operation of the apparatus when used for shredding and filling two different cheese components is illustrated as follows. The apparatus shreds eight cheese blocks 33 at the same time. The four chutes 34 on both sides of the apparatus are filled. Photoeyes 67 (FIG. 2) above the conveyor signal whether or not a tray is present along each of the four locations on the conveyor, which has a row of four trays per index, as generally shown in FIG. 2. This photoeye input can be used as data for a suitable control device for the on-line operation discussed herein. During each index of the conveyor, if there are any trays present under the shredder, an air clutch enables the motor to turn all eight shredder blades simultaneously. There are a total of eight grater fixtures 16 and four idlers 68 joining two of them as illustrated particularly in FIG. 2. In general, the line indexes, after which it dwells for a time during loading and tamping, after which the gates are closed.

During each index of the conveyor, there are eight separately operated drive cylinders 36 for push blocks 35. Each pushes a cheese block into the respective shredder for a given time, typically on the order of one second or less. Each individual pusher operates in conjunction with the photoeye upstream from the particular drive cylinder and push block which signals that a tray is present under the pusher. At the beginning of the dwell of the conveyor, lifters 59 raise the conveyor to place the trays toward and/or against the exit openings of the shredder. The four gates for the four upstream fixtures will all open if trays are present at the beginning of dwell. Likewise, the four gates on the downstream portion will also open when trays are indicated as being present under each individual gate.

Typically, there is a delay of about one second for the cheese to free fall from the shredder blade through the discharge passageways and into the tray pockets. After this delay, the tampers will activate for a length of time, typically less than 0.5 second, in order to level the cheese that has fallen into the tray pocket. After the tampers are deactivated, the lifters lower the conveyor. Then, the gates close after a delay of sufficient duration to permit the tampers to move back above and clear the gates before they close. The apparatus then indexes again, starting the on-line sequence again.

It will be understood that the embodiments of the present invention which have been described are illustrative of some of the applications of the principles of the present invention. Numerous modifications may be made by those skilled in the art without departing from the true spirit and scope of the invention.

We claim:

1. An apparatus for automatically shredding a pre-portioned quantity of a product such as cheese and the like and for loading the thus shredded pre-portioned product into a pocket of a packaging component within which the shredded pre-portioned product is to be marketed, the apparatus comprising:

a conveying assembly by which a packaging component is conveyed such that a pocket of the packaging component is brought to a pre-designated alignment location;

a chute containing a plurality of pre-portioned products, each said pre-portioned product being a pre-portioned quantity of product such as block cheese and the like;

a shredder assembly having a moving grater suitable for grating one of said pre-portioned products;

a staging compartment for receiving one of said pre-portioned products from said chute and temporarily positioning the pre-portioned product, said staging compartment being adjacent to said shredder assembly;

a pusher assembly adjacent to said staging compartment, said pusher assembly moves the pre-portioned product from the staging compartment into said shredder assembly to thereby grate substantially the entirety of the pre-portioned product into a pre-portioned grated product;

a fixed transfer passageway by which the pre-portioned grated product is directed from said shredder assembly and to said pre-designated alignment location, at which location said pre-portioned grated product enters into the pocket of the packaging component, said fixed transfer passageway including a funnel housing having an exit lip closely above the pocket of the packaging component when the packaging component is at the pre-designated alignment location; and a tamping assembly having a tamping tool, said tamping tool moving through at least a portion of said fixed transfer passageway and through and beyond said exit lip of the funnel housing, whereby the tamping tool engages the pre-portioned grated product within the pocket of the packaging component so as to level the grated product while it is within the pocket of the packaging component.

2. The apparatus in accordance with claim 1, wherein said moving grater of the shredder assembly has a plurality of orifices therethrough, the orifices having blade-like surfaces, and said pusher assembly advances the pre-portioned product through the orifices to grate the product.

3. The apparatus in accordance with claim 1, wherein said moving grater of the shredder assembly is a generally cylindrical grater having orifices therethrough, and said pusher assembly advances the pre-portioned product to and through the orifices while the cylindrical grater is rotating.

4. The apparatus in accordance with claim 1, further including a movable gate generally at said pre-designated alignment location, said movable gate being closeable to prevent passage of the pre-portioned grated product out of the shredding and loading apparatus, and said movable gate being openable to permit passage of the pre-portioned grated product into the pocket of the packaging component.

5. The apparatus in accordance with claim 4, wherein said moveable gate is adjacent to said exit lip of the funnel housing.

6. The apparatus in accordance with claim 5, wherein the tamping tool passes through the exit lip when the moveable gate is open.

7. The apparatus in accordance with claim 1, wherein said exit lip has a size and shape which is complementary to the size and shape of the pocket of the packaging component when same is at the pre-designated alignment location.

8. The apparatus in accordance with claim 1, wherein an assembly is provided for movement whereby the conveying assembly is closer to the transfer passageway at the pre-designated alignment location.

9. The apparatus in accordance with claim 1, wherein said exit lip has a size and shape which is complementary to the size and shape of the pocket of the packaging component and is aligned therewith when same is at the pre-designated alignment location, and wherein an assembly is provided for movement whereby the conveying assembly is closer to the transfer passageway at the pre-designated alignment location.

10. The apparatus in accordance with claim 1, wherein said conveying assembly has means for indexing each packaging component at two separate locations, one being said pre-designated alignment location for said pocket of the packaging component, and the other being a second pre-designated location at which a second pocket of the packaging component is brought into alignment therewith, and including a second transfer passageway by which a second pre-portioned grated product is directed to said second pre-designated alignment location, at which second location said second pre-portioned grated product enters into the second pocket of the packaging component.

11. The apparatus in accordance with claim 10, wherein said conveying assembly includes a plurality of lanes, whereby a plurality of said packaging components are loaded with pre-portioned grated product into both of said pockets of each said packaging components.

* * * * *